US006895852B2

(12) United States Patent
Pieper

(10) Patent No.: US 6,895,852 B2
(45) Date of Patent: May 24, 2005

(54) APPARATUS AND METHOD FOR PROVIDING REDUCED HYDRAULIC FLOW TO A PLURALITY OF ACTUATABLE DEVICES IN A PRESSURE COMPENSATED HYDRAULIC SYSTEM

(75) Inventor: Gary J. Pieper, Eagle, WI (US)

(73) Assignee: HUSCO International, Inc., Waukesha, WI (US)

( * ) Notice: Subject to any disclaimer, the term of this patent is extended or adjusted under 35 U.S.C. 154(b) by 137 days.

(21) Appl. No.: 10/428,460

(22) Filed: May 2, 2003

(65) Prior Publication Data

US 2004/0216599 A1 Nov. 4, 2004

(51) Int. Cl.[7] ..... F15B 11/02
(52) U.S. Cl. ..... 91/516; 60/422
(58) Field of Search ..... 60/422; 91/446, 91/447, 516

(56) References Cited

U.S. PATENT DOCUMENTS 4,693,272 A 9/1987 Wilke
5,715,865 A 2/1998 Wilke
5,791,142 A 8/1998 Layne et al.
5,890,362 A 4/1999 Wilke
5,950,429 A * 9/1999 Hamkins ..... 60/422
6,318,079 B1 11/2001 Barber

OTHER PUBLICATIONS

BOBCAT 322 D–Series Compact Excavator Brochure, Bobcat Company, West Fargo, ND.

* cited by examiner

*Primary Examiner*—Edward K. Look
*Assistant Examiner*—Michael Leslie
(74) *Attorney, Agent, or Firm*—George E. Haas; Quarles & Brady LLP

(57) ABSTRACT

An apparatus and method for controlling hydraulic output to a plurality of actuatable devices are disclosed. The apparatus includes a plurality of main valves coupled, respectively, to the actuatable devices and to respective secondary valves, and also an adjustment valve that is coupled between a pressure source and one or more of the secondary valves. The adjustment valve receives a first indication of a pressure at the one or more secondary valves, and a second indication related to a highest load pressure. The adjustment valve allows pressure to be provided from the pressure source to the one or more secondary valves when the second indication exceeds the first indication, such that an equal amount of fluid flow occurs with respect to each of those secondary valves that is reduced in comparison with the fluid flow to any other secondary valves that are not connected to the adjustment valve.

18 Claims, 4 Drawing Sheets

APPARATUS AND METHOD FOR PROVIDING REDUCED HYDRAULIC FLOW TO A PLURALITY OF ACTUATABLE DEVICES IN A PRESSURE COMPENSATED HYDRAULIC SYSTEM

FIELD OF THE INVENTION

The present invention relates to hydraulic systems for work vehicles, and particularly hydraulic systems that are compensated to regulate pressure differentials existing across metering orifices of control valves within the hydraulic systems.

BACKGROUND OF THE INVENTION

Hydraulic systems are employed in many circumstances to provide hydraulic power from a hydraulic power source to multiple loads. In particular, such hydraulic systems are commonly employed in a variety of work vehicles such as excavators and loader-backhoes. In such vehicles, the loads powered by the hydraulic systems may include a variety of actuatable devices such as cylinders that lower, raise and rotate arms, and lower and raise buckets, as well as hydraulically-powered motors that drive tracks or wheels of the vehicles. Although the various actuatable devices typically are powered by a single source (e.g., a single pump), the rates of fluid flow to the different devices typically are independently controllable, through the use of separate control valves (typically spool valves) that are independently controlled by an operator of the work vehicle.

The operation of the actuatable devices depends upon the hydraulic fluid flow to those devices, which in turn depends upon the cross-sectional areas of metering orifices of the control valves between the pressure source and the actuatable devices, and also upon the pressure differentials across those metering orifices. To facilitate control, hydraulic systems often are pressure compensated, that is, designed to set and maintain the pressure differentials across the metering orifices of the control valves, so that controlling of the valves by an operator only tends to vary the cross-sectional areas of the orifices of those valves but not the pressure differentials across those orifices. Such pressure compensated hydraulic systems typically include compensation valves positioned between the respective control valves and the respective actuatable devices. The compensation valves control the pressures existing on the downstream sides of the metering orifices to produce the desired pressure differentials across the metering orifices.

Such pressure compensated hydraulic systems normally ensure that the same particular pressure differential (e.g., a pump margin pressure) occurs across each of the control valves. Nevertheless, it is desirable in some hydraulic systems to have a lower pressure differential across selected valves to reduce the hydraulic fluid flow through those valves. For example, in the case of an excavator, it may be desirable to provide normal hydraulic fluid flow to the cylinders that control lifting or other movement of an arm or bucket of the excavator, or to accessories of the excavator such as a trenching device, yet at the same time desirable to provide reduced hydraulic fluid flow to the hydraulic motors controlling the speeds of the tracks of the excavator so that the excavator travels at reduced speeds. Therefore, there is a need in some hydraulic systems to provide a pressure differential across metering orifices in selected control valves which is less than the pressure differential across other control valves.

Various modifications to pressure compensated hydraulic systems have been developed in the past to allow for different pressure differentials across different control valves. One modification is to place an additional orifice in series with the control valve, where the additional orifice may be fixed to define the maximum flow or it may be adjustable so that the operator can select a desired flow. Another technique, with a spring-operated compensation valve, is to adjust the spring load mechanically while leaving the metering area constant. Both of these conventional techniques require additional mechanical devices that may be difficult to implement or locate with respect to existing valve components in a valve assembly. The latter technique also requires sizeable springs to handle the relatively large loads that act on them.

Further, using these conventional techniques, it is difficult or impossible to adjustably control the pressure differentials across multiple control valves so that each of the control valves experiences the same pressure differential. In particular, the providing of fixed additional orifices does not allow for adjustable control of pressure differentials, while the providing of individual adjustment springs for each compensation valve makes it difficult for an operator to evenly set the pressure differentials occurring across different control valves.

This capability of providing adjustable control of the pressure differentials across multiple control valves in an even manner is nevertheless desirable in many circumstances, since it is often desirable that multiple hydraulic devices of a hydraulic system should receive precisely identical amounts of hydraulic fluid flow when an operator sets the respective control valves identically. For example, with respect to the excavator discussed above, it would be desirable that the hydraulic motors corresponding to the left and right tracks of the excavator be driven at the exact same speed assuming that the operator of the excavator set the control valves for those motors to the same level.

Therefore, it would be advantageous if pressure compensated hydraulic systems could be designed so that reduced pressure differentials could be imparted across multiple control valves without the use of many additional, unwieldy components. Additionally, it would be advantageous if pressure compensated hydraulic systems could be designed to allow for adjustable control of the pressure differentials across multiple control valves, where the adjustments affected each of the pressure differentials equally. It would further be advantageous if such modified pressure compensated hydraulic systems allowed for an operator to adjust the pressure differentials across multiple control valves by way of a single switch and/or dial that imparted desired adjustments to all of the multiple control valves simultaneously. Additionally, it would be advantageous if such pressure compensated hydraulic systems allowing for adjustable control did not require significant additional numbers of components, and were otherwise relatively inexpensive to implement, in comparison with existing pressure compensated hydraulic systems.

SUMMARY OF THE INVENTION

The present inventors have realized that existing pressure compensated hydraulic systems can be modified to include an adjustable pressure reducing valve that communicates pressure from a source (e.g., a pump) to the particular compensation valves that are coupled to the control valves for which adjustable control is desired. The opposing actuation ports of the adjustable pressure reducing valve are coupled, respectively, to the pressure applied to those particular compensation valves and to the highest load pressure plus an adjustment spring pressure. Consequently, the pressure applied to the particular compensation valves exceeds that of the highest load pressure by the adjustment spring pressure, which results in reduced pressure differentials across the control valves associated with those compensation valves. Because the adjustable pressure reducing valve is in communication with each of the particular compensation valves that are coupled to the control valves for which adjustable control is desired, and because the single adjustment spring pressure determines the operation of that adjustable pressure reducing valve, an operator only needs to make a single adjustment to the single adjustment spring pressure to produce the same changes to the pressure differentials across each of the control valves for which adjustable control is desired. In certain embodiments, another valve is coupled between the adjustable pressure reducing valve, the highest load pressure and the particular compensation valves of interest. In such embodiments, the reduction in the pressure differentials produced by the adjustable pressure reducing valve can be switched on and off by alternatively coupling the particular compensation valves to the output of the adjustable pressure reducing valve and to the highest load pressure, respectively.

In particular, the present invention relates to an apparatus for providing a reduced hydraulic flow output to a plurality of actuatable devices, where each of the actuatable devices receives respective amounts of hydraulic fluid from a shared pump, and where the respective amounts of hydraulic fluid received by the respective actuatable devices are substantially independent of differences in respective load pressures associated with the respective actuatable devices. The apparatus includes a plurality of main valves each having a respective first port and a respective second port. The apparatus further includes a plurality of secondary valves coupled respectively to the respective second ports of the respective main valves. The apparatus additionally includes an adjustment valve that has first and second actuation ports and is coupled between respective actuation ports on each of the secondary valves and a pressure source. The first actuation port receives a first indication of a pressure at the respective actuation ports of the secondary valves and the second actuation port receives a second indication of a highest load pressure adjusted by an amount. The adjustment valve allows hydraulic pressure to be provided from the pressure source to the respective actuation ports of the secondary valves when the second indication exceeds the first indication.

The present invention additionally relates to a hydraulic system for implementation in a work vehicle. The hydraulic system includes a plurality of actuatable devices, and a plurality of valves having respective metering orifices, where the respective valves are coupled to the respective actuatable devices, and where hydraulic fluid flow to the respective actuatable devices is determined at least in part by respective areas of the respective metering orifices and respective pressure differentials across the respective metering orifices. The hydraulic system further includes means for regulating the respective pressure differentials across the respective metering orifices so that the respective pressure differentials do not vary substantially in response to variations in the loads at actuatable devices. The hydraulic system additionally includes means for biasing the means for regulating, so that the respective pressure differentials across the respective metering orifices of more than one of the respective valves are decreased.

The present invention further relates to a method of providing different hydraulic fluid flow rates to different actuatable devices. The method includes providing a plurality of control valves, where each valve has a respective metering orifice having a respective controllable area, providing a plurality of secondary valves coupled between the respective metering orifices and the respective actuatable devices, and applying a first pressure related to a highest load pressure to a first group of the secondary valves so that those secondary valves cause a first pressure differential to exist across the metering orifices of each of the control valves coupled to those secondary valves. The method additionally includes applying a second pressure related to a sum of the highest load pressure and a spring pressure to a second group of the secondary valves so that those secondary valves cause a second pressure differential to exist across the metering orifices of each of the control valves coupled to those secondary valves.

DETAILED DESCRIPTION OF THE INVENTION

Figure 1:
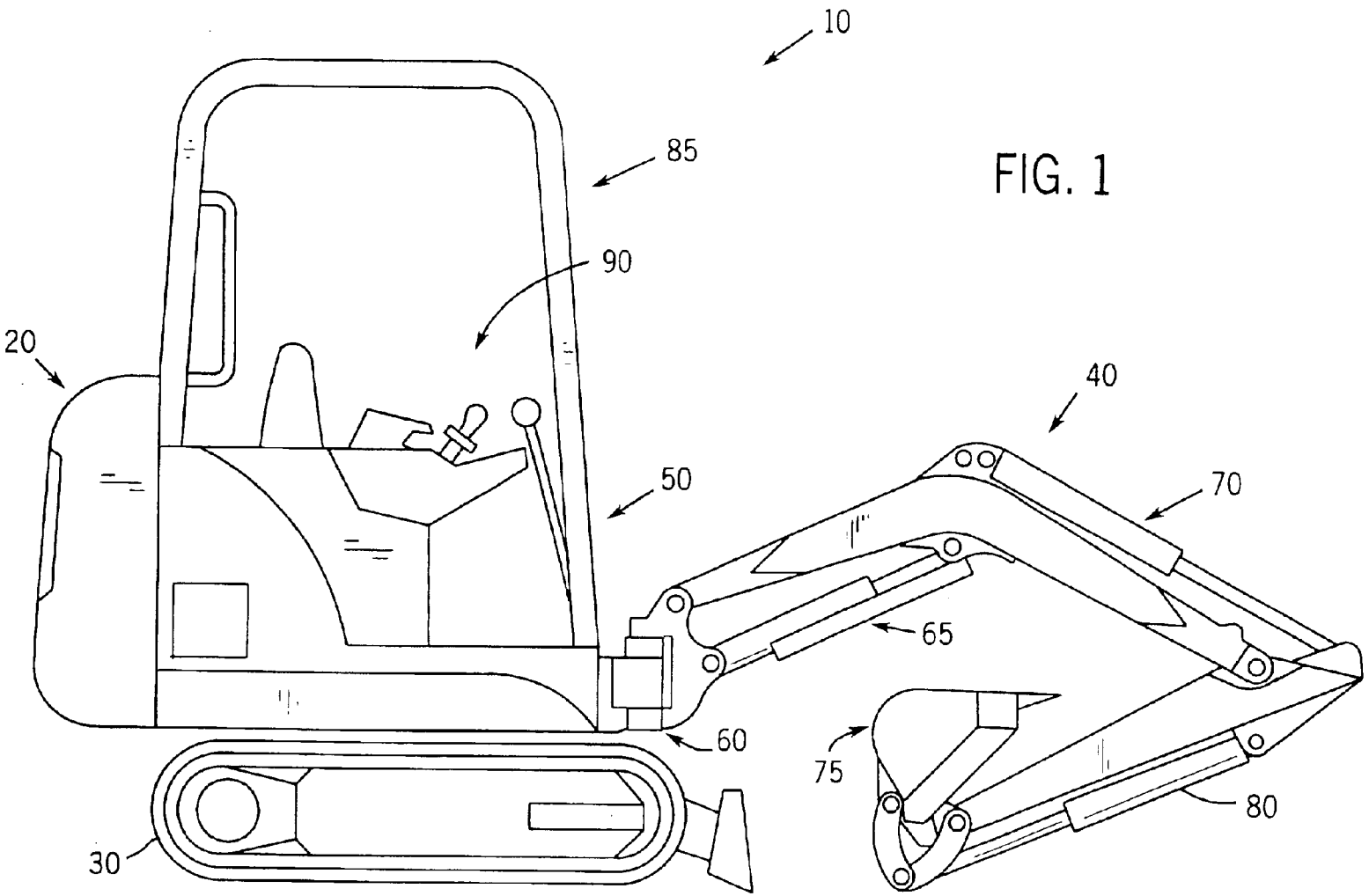
FIG. 1 is a side elevation view of an excavator, which is intended to be exemplary of a variety of hydraulically-actuated work vehicles.

Referring to FIG. 1, a side elevation view of an excavator 10 is provided. The excavator 10 is meant to be exemplary of a wide variety of hydraulically-actuated work vehicles, which could also include, for example, loader-backhoes, articulated work vehicles and a variety of other vehicles. As shown, the excavator 10 in particular includes a main chassis 20, which rests upon left and right tracks 30 (only the right track is shown), and also an articulated arm 40 coupled to a front 50 of the chassis 20. The articulated arm 40 in the present embodiment is rotatable about a pivot 60 on the front 50 and can be raised and lowered by way of first and second hydraulic pistons 65 and 70, respectively. A bucket 75 on the arm 40 can further be swung outward or inward by way of a third piston 80.

Each of the left and right tracks 30 is driven independently by a respective hydraulic motor (not shown). Within a cab 85 of the excavator 10, a number of levers and other controls 90 are provided so that an operator of the excavator can control the speed and direction of the excavator and further control the pivoting and articulation of the arm 40. In the present embodiment, the excavator 10 is entirely hydraulically powered, that is, there is only a single hydraulic pump power source that supplies the power for all of the actuatable devices (the pistons 65, 70 and 80, and the two hydraulic motors). However, in alternate embodiments, the excavator (or other work vehicle) could be both partly hydraulically powered and partly powered by way of another power source.

Figure 2:
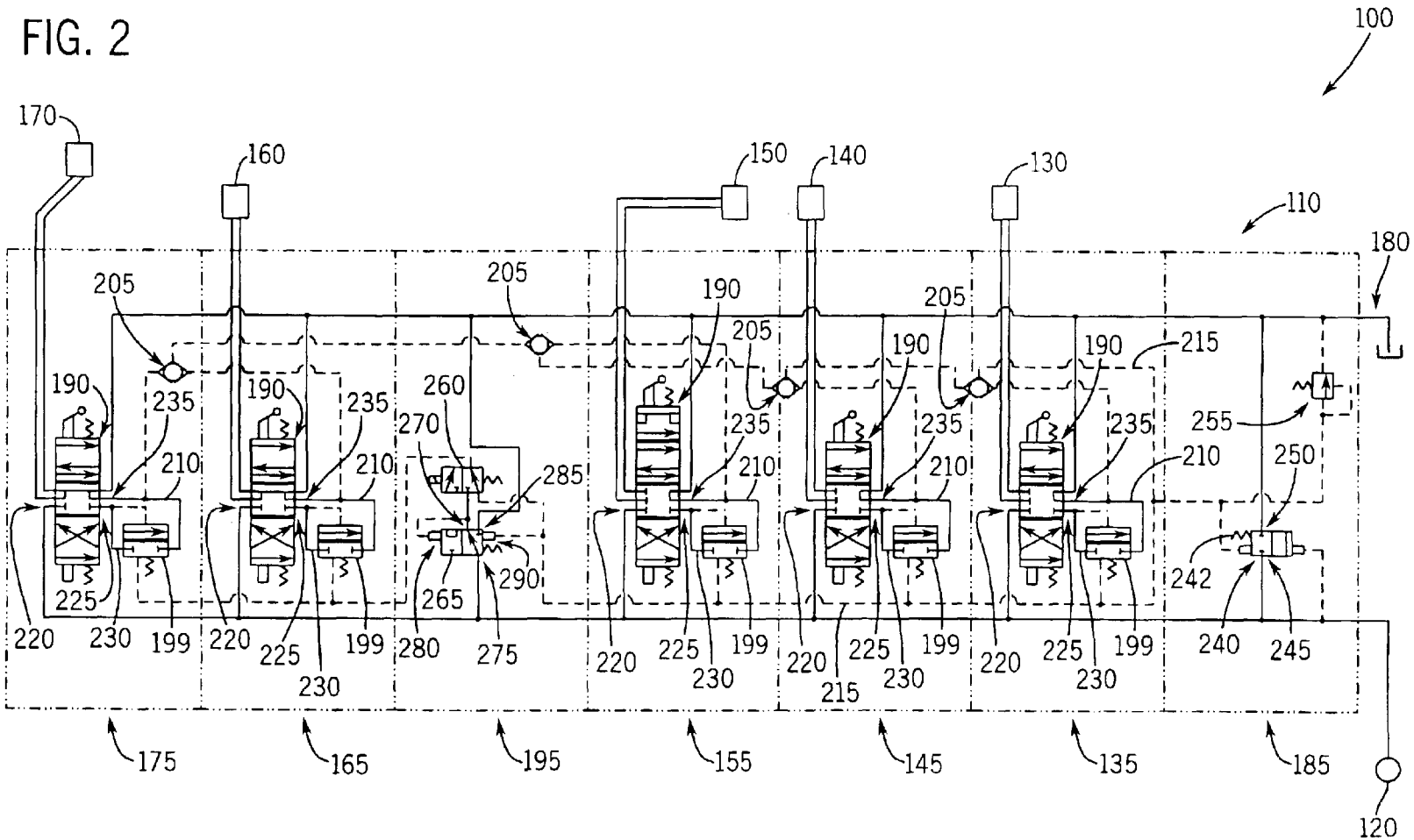
FIG. 2 is a schematic diagram showing an exemplary hydraulic system that controls hydraulic fluid flow to multiple actuatable devices, where the system employs pressure compensation and, additionally, includes components allowing for adjustable flow control with respect to more than one of the actuatable devices.

Turning to FIG. 2, components of an exemplary hydraulic system 100 for implementation in the excavator 10 are shown schematically. Specifically, FIG. 2 shows components of a valve assembly 110 that govern the communication of fluid pressure from a pump 120 to first, second, third, fourth and fifth actuatable devices 130, 140, 150, 160 and 170, respectively, and then to a tank 180. In the embodiment shown, the valve assembly 110 is a sectional valve assembly including first, second, third, fourth, fifth, sixth, and seventh valve sections 135, 145, 155, 165, 175, 185 and 195, respectively. Each of the first, second, third, fourth and fifth valve sections 135, 145, 155, 165 and 175 includes a respective control spool valve 190 and a respective compensation valve 199 by which the respective valve sections control the flow of hydraulic fluid to the respective actuatable devices 130, 140, 150, 160 and 170, respectively.

Specifically, the pump 120 is coupled to each of the control spool valves 190 at respective first input workports 220 of those control spool valves. Corresponding respective output workports 225 of those control spool valves are in turn coupled to input ports of the respective compensation valves 199 by way of respective intermediate lines 230. The hydraulic pressure associated with the intermediate lines 230 is also applied to one actuation port of each of the respective compensation valves 199. Output ports of the respective compensation valves 199 are coupled by way of additional lines 210 to second input workports 235 of the respective control spool valves 190. The hydraulic pressures experienced at the respective additional lines 210 correspond to the respective hydraulic load pressures of the respective actuatable devices 130, 140, 150, 160 and 170, when the respective control spool valves are opened. Each of the control spool valves 190 is controllable by an operator, who is able to control the areas of metering orifices and the fluid flow directions within the valves by adjusting the valves' positions by way of the controls 90 (see FIG. 1).

The first, second and third valve sections 135, 145 and 155 of the valve assembly 110 operate to provide controlled flow of hydraulic fluid using conventional post pressure compensation technology such as the COMP-CHEK technology offered by HUSCO International, Inc. of Pewaukee, Wis. and as disclosed, for example, in U.S. Pat. No. 4,693,272 to Wilke, which issued on Sep. 15, 1987, and which is hereby incorporated by reference herein. In accordance with this technology, the flow of hydraulic fluid from the pump 120 to the actuatable devices, such as devices 130, 140 and 150, is determined solely by the respective positions of the respective control spool valves 190, which correspond to a particular throw or metering orifice areas through those respective spool valves. That is, the hydraulic fluid flow to the first three actuatable devices 130, 140 and 150 does not vary from spool valve to spool valve due to varying pressure differentials across the metering orifices of the respective control spool valves because, even though the hydraulic pressures associated with each of the respective actuatable devices may vary from device to device, the pressure differentials across each of the control spool valves 190 of the valve sections 135, 145 and 155 are maintained at identical levels through the operation of the compensation valves 199.

As shown, the valve assembly 110 includes a network of shuttle valves 205 that are coupled in between respective pairs of the lines 210 of the valve sections 135, 145, 155, 165 and 175. Each of the shuttle valves 205 respectively compares the two hydraulic pressures that are provided to it and outputs the larger of the two pressures. Consequently, the network of shuttle valves 205 provides at a load sense line 215 a pressure that is the maximum of the pressures experienced at the respective lines 210, which in turn represents the largest hydraulic load pressure that is currently being experienced.

Specifically with reference to the first, second and third valve sections 135, 145 and 155, the load sense line 215 is coupled to the respective actuation ports of the respective compensation valves 199 that are opposite the respective actuation ports that are coupled to the intermediate lines 230. Due to the interaction of the opposing pressures applied to the opposing actuation ports of the respective compensation valves 199, the compensation valves tend to open sufficiently only so that the hydraulic pressures experienced in each of the intermediate lines 230 is equal to the maximum hydraulic load pressure (or a pressure differing from that maximum load pressure by a certain amount determined by spring forces applied to the compensation valves).

Because the same maximum hydraulic load pressure is applied to each of the compensation valves 199 of the first three valve sections 135, 145 and 155, the same pressure is experienced at each of the intermediate lines 230 (assuming that any spring pressures within the respective compensation valves 199 are appropriately set). Because each of the respective pressures in the intermediate lines 230 are equal to one another, the pressure differentials between each of the pairs of first input and first output workports 220, 225 of the respective control spool valves 190 of the first three valve sections 135, 145 and 155 are identical, even though the actual hydraulic load pressures at the first, second and third actuatable devices 130, 140 and 150 are not identical. Further, as a result, the respective rates of fluid flow through each of the respective control spool valves 190 do not depend upon the pressure differentials across those spool valves, but rather only depend on the areas of the metering orifices of the respective valves, which are respectively determined by the operator's physical positioning of the valves.

Further as shown in FIG. 2, in the present embodiment, the load sense line 215 is also coupled to an actuation port of an unloading valve 240, with the pump 120 also being coupled to the opposite actuation port of that valve. A margin pressure spring 242 applies pressure also to the same actuation port as the load sense line 215. The unloading valve 240 has an input port 245 that is coupled to the pump 120 and an output port 250 that is coupled to the tank 180. Consequently, hydraulic fluid is directed from the pump 120 to the tank 180 whenever the pump pressure is greater than the highest load pressure plus the margin pressure determined by the spring 242, such that the pump pressure provided to the control spool valves 190 is never more than the highest load pressure plus the margin pressure. In alternate embodiments, a variable displacement pump can be used in place of the fixed pump 120 and the unloading valve 240. Also as shown in FIG. 2, the load sense line 215 is further coupled to a safety valve 255, which dumps hydraulic fluid to the tank 180 in circumstances where the highest load pressure exceeds a maximum amount such as, in the embodiment shown, 3,000 pounds per square inch.

In contrast to conventional valve assemblies, the valve assembly 110 allows for adjustable flow control with respect to multiple actuatable devices in addition to the first, second and third actuatable devices 130, 140 and 150 that are controlled using conventional post-pressure compensation.

In the embodiment shown, the fourth and fifth actuatable devices 160 and 170 can be controlled using this adjustable flow control system. Specifically as shown, the seventh valve section 195 includes an adjustable pressure reducing valve 265 and a drive mode selector valve 260, which operates effectively as a switch between two modes of operation.

In a first mode of operation, the maximum load pressure provided by way of the load sense line 215 is coupled through the drive mode selector valve (which can be a three-way selector valve) 260 to actuation ports of each of the compensation valves 199 of the respective valve sections 165 and 175, just as that maximum load pressure is provided by way of the load sense line to the corresponding actuation ports of the compensation valves 199 of the first, second and third valve sections 135, 145 and 155. Thus, in this first mode of operation, the fourth and fifth valve sections 165 and 175 are post-pressure compensated in the same manner as the first, second and third valve sections 135, 145 and 155 are post-pressure compensated. That is, each of the respective lines 230 coupling the respective first output workports 225 of the respective control spool valves 190 to the respective compensation valves 199 of the respective fourth and fifth valve sections 165 and 175 are kept at a pressure equaling that of the highest load pressure that is currently being experienced by any of the actuatable devices 130, 140, 150, 160 and 170 (as adjusted by any pressures applied by springs in the compensation valves 199).

However, when the drive mode selector valve 260 is switched to a second mode of operation, typically by way of an operator input, the actuation ports of the compensation valves 199 of the fourth and fifth valve sections 165 and 175 are instead coupled through the drive mode selector valve 260 to an output port 270 of the adjustable pressure reducing valve 265. An input port 275 of the adjustable pressure reducing valve 265 is further coupled to the pump 120. First and second actuation ports 280 and 285, respectively, of the adjustable pressure reducing valve 265 are respectively coupled to the output port 270 and to the load sense line 215, and additionally a spring 290 applies pressure to the second actuation port as well. Consequently, the pressure applied to the actuation ports of the compensation valves 199 of the fourth and fifth valve sections 165 and 175 is greater than that of the highest load pressure provided by the load sense line 215 by an amount determined by the setting of the spring 290, which in certain embodiments can be adjusted by an operator turning a dial.

Thus, in the second mode of operation, depending upon an operator's setting of a dial (or other input), the pressure differential between the first input workports 220 and first output workports 225 of the control spool valves 190 of the fourth and fifth valve sections 165 and 175 is less than the pressure differential across the corresponding workports of the spool valves of the first, second and third valve sections 135, 145 and 155 by an amount determined by the spring 290. The pressure differentials across each of the control spool valves 190 of the fourth and fifth valve sections 165, 175 are affected equally. As a result, the amount of fluid flow provided to the fourth and fifth actuatable devices 160 and 170 is less than it would otherwise be in the first mode of operation. That is, given identical positions of all of the spool valves of all of the five valve sections, less fluid flows to the fourth and fifth actuatable devices 160 and 170 than to the first, second and third actuatable devices 130, 140 and 150. In one embodiment, the adjustable pressure reducing valve acts with a 1:1 area ratio, although other ratios are possible.

In order to achieve a minimum (0) flow setting, the spring 290 and the adjustable pressure reducing valve 265 must have enough force to overcome the margin pressure, thus remaining in a fully open position sending inlet passage pressure to the compensation valves 199. When this occurs, the pressures on both sides of each compensation valve 199 are equal, with the compensation valve's bias spring forcing the compensation valve into a closed position, resulting in a minimum (0) flow adjustment.

In another embodiment, it is possible to remove the drive mode selector valve 260 such that the output port 270 of the adjustable pressure reducing valve is directly coupled to the compensation valves 199 of the valve sections 165 and 175, and such that only one mode of operation is possible. In still another embodiment, it would be possible to have the minimum load of the spring 290 be such that the output pressure is fixed at a given percentage of the margin pressure (50% for example). This would give the affected functions a two speed operation—full speed in the first mode (normal COMP-CHEK) and 50% speed in the second mode.

The hydraulic system 100 of FIG. 2 is meant to be representative of a variety of hydraulic systems that are capable of being implemented in a variety of machines or other systems, including machines such as the excavator 10 of FIG. 1. Depending upon the embodiment, the number of valve sections (such as the first, second, and third valve sections 135, 145 and 155) that employ conventional post-pressure compensation technology can vary from the three valves shown. Also, the number of valve sections such as the fourth and fifth valve sections 165, 175 that are able to provide adjustable flow control also can vary from the number shown to more than two or less than two such valve sections with corresponding spool valves and compensation valves.

In the embodiment of FIG. 2, the valve assembly 110 is a sectioned valve assembly with the multiple valve sections 135, 145, 155, 165, 175, 185 and 195, which are discrete components that can be assembled or removed from one another to form different valve assemblies. Nevertheless, the present invention is also applicable to valve assemblies that are of mono-block construction (e.g., where all of the valve components are manufactured as a single casting). Also, the types of valves used can vary depending upon the embodiment. That is, the control spool valves 190 can be other types of valves other than spool valves in alternate embodiments, and the compensation valves 199 can be spool valves or other types of valves.

The adjustable flow control provided by the present invention is particularly useful in that it allows for adjustable flow control of hydraulic fluid flow to multiple actuated devices, that is, even among those devices. Thus, the valve assembly 110 allows certain actuatable devices (e.g. the first, second and third devices 130, 140 and 150) to be provided with hydraulic fluid at rates that are determined by a first fluid pressure differential across each of the respective control spool valves 190 of the first, second and third valve sections 135, 145 and 155, and at the same time allows certain other actuatable devices (e.g., the fourth and fifth actuatable devices 160 and 170) to be provided with hydraulic fluid flow that is determined by a second pressure differential across each of the respective spool valves 190 of those valve sections (e.g., the fourth and fifth valve sections 165 and 175), which is determined by the particular setting of the adjustable pressure reducing valve 265. Thus, the valve assembly 110 allows for normal hydraulic fluid flow to be provided to a variety of actuatable devices while a second, lesser amount of fluid flow is provided to a second group of actuatable devices.

This can be helpful in a variety of circumstances. For example, with respect to the excavator 10, the first, second and third actuatable devices 130, 140 and 150 can correspond to the pistons 65, 70 and 80, respectively (or other actuatable devices such as a trencher attached to the excavator, an auxiliary hydraulic mechanism or a tilting mechanism) and the fourth and fifth actuatable devices 160 and 170 respectively can correspond to the hydraulic motors used to move the left and right tracks 30 of the excavator 10. Because of the adjustable flow control, it would be possible for an operator to maintain normal hydraulic fluid flow control with respect to all hydraulically actuated devices except for the tracks of the excavator, which would receive reduced flow. This could be helpful in circumstances where it was desired that the excavator 10 move at a slower rate than normal even though all other operations were operating normally. Because the adjustable flow control as determined by the setting of the adjustable pressure reducing valve 265 affects the operation of the control spool valves 190 of each of the fourth and fifth valve sections 165 and 175 equally, use of the adjustable flow control would provide equal changes in the speeds of the respective left and right tracks of the vehicle (assuming that the respective levers controlling the respective positions of the spool valves 190 of the respective valve sections 165 and 175 were positioned identically).

Figure 3:
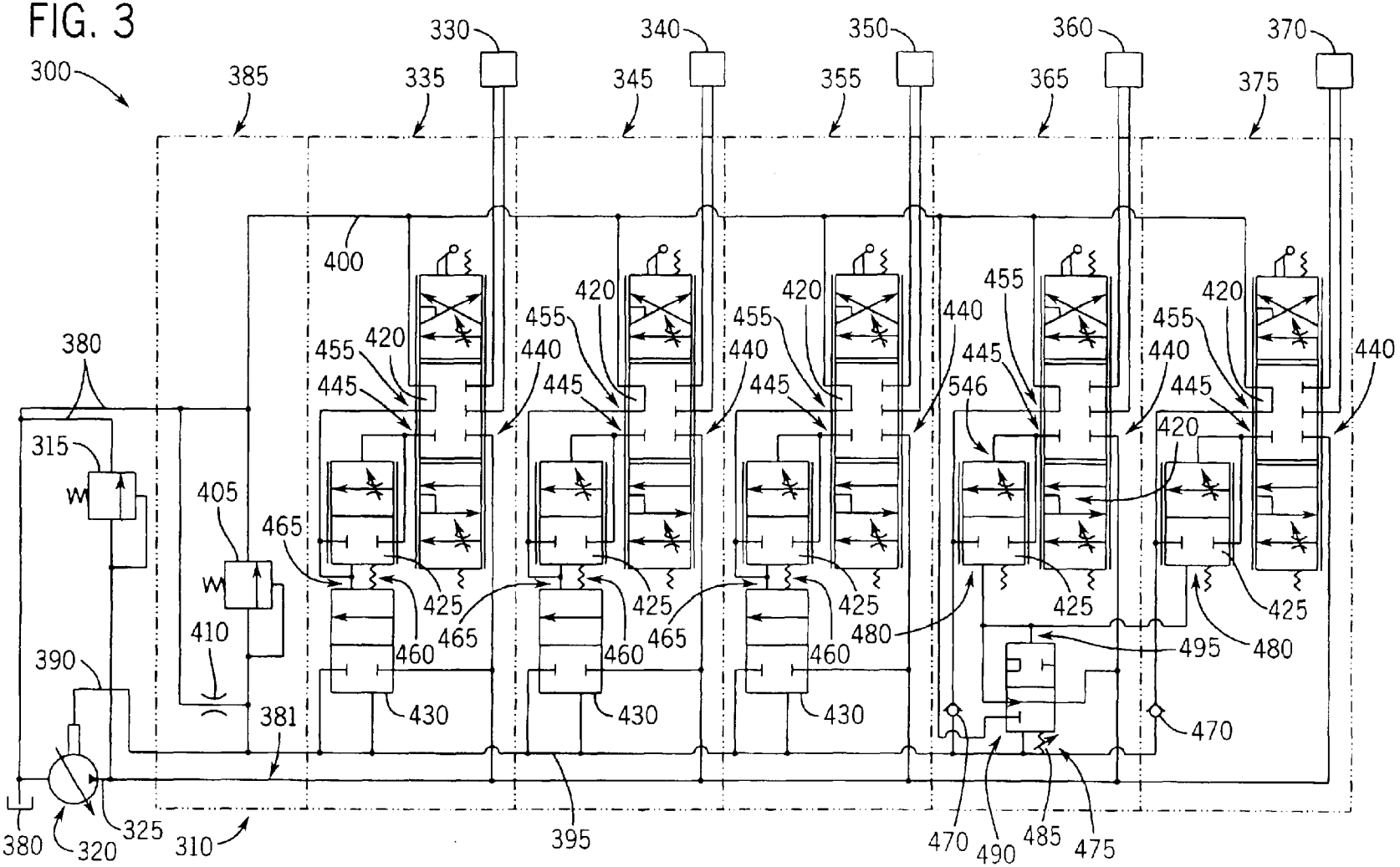
FIG. 3 is a schematic diagram showing another exemplary hydraulic system that controls hydraulic fluid flow to multiple actuatable devices, where the system employs isolated pressure compensation and, additionally, includes components allowing for adjustable flow control with respect to more than one of the actuatable devices.

Turning to FIG. 3, another hydraulic system 300 employing another valve assembly 310 is shown, which employs an alternate embodiment of the present invention. As in the embodiment of FIG. 2, the valve assembly 310 has first, second, third, fourth, and fifth valve sections 335, 345, 355, 365, and 375 that respectively control the actuation of first, second, third, fourth and fifth actuatable devices 330,340, 350,360 and 370, respectively, which can be hydraulic pistons/cylinders, hydraulic motors, or a variety of other hydraulically-actuated devices. The valve assembly 310 also includes a sixth valve section 385, which is discussed further below. Although FIG. 3 shows the valve assembly 310 to be formed from the multiple separate valve sections 335–385, in alternate embodiments the valve assembly can be of mono-block form.

The first, second, third, fourth and fifth valve sections 335,345,355,365 and 375 specifically control the flow of hydraulic fluid from a pump 320 to the first, second, third, fourth and fifth actuatable devices 330,340,350,360 and 370, respectively, and the return of the fluid to a reservoir or tank 380. The output of the pump 320 is protected by a pressure relief valve 315. The pump 320 typically is located remotely from the valve assembly 310 and is connected by a supply conduit or hose 325 to a supply passage 381 extending through the valve assembly 310 (the same is typically true with respect to the valve assembly 110 of FIG. 2). The pump 320 in this embodiment is a variable displacement type pump having an output pressure designed to be the sum of the pressure at a load sense port 390 plus a constant pressure or margin. The load sense port 390 is connected to a load sense passage 395 that extends through the sections 335–385 of the valve assembly 310. A reservoir passage 400 also extends through the valve assembly 310 and is coupled to the tank 380. The sixth valve section 385 of the valve assembly 310 contains ports for connecting the supply passage 381 to the pump 320, the reservoir passage 400 to the tank 380 and the load sense passage 395 to the load sense port 390 of pump 320. The sixth valve section 385 also includes a pressure relief valve 405 that relieves excessive pressure in the load sense passage 395 to the tank 380. An orifice 410 also provides a flow path between the load sense passage 395 and the tank 380.

Each of the first, second and third valve sections 335,345 and 355 operates in accordance with a second type of pressure compensation mechanism that is different than the post pressure compensation discussed above with reference to FIG. 2. In one embodiment, this second type of pressure compensation mechanism is an ISO-COMP pressure compensation mechanism manufactured by Husco International Inc. of Pewaukee, Wis., attributes of which are disclosed in U.S. Pat. No. 5,890,362 to Wilke, which issued on Apr. 6, 1999, and which is hereby incorporated by reference herein.

Still referring to FIG. 3, each of the first, second and third valve sections 335,345 and 355 includes a respective control spool valve 420, a respective compensating spool valve 425, and a respective additional valve element 430. Similar to the embodiment of FIG. 2, hydraulic fluid from the pump 320 is provided by way of the supply passage 381 to respective first input workports 440 of each of the respective control spool valves 420 of the valve sections 335,345 and 355. Depending upon the positioning of the respective control spool valves 420, the fluid provided to the respective first input workports 440 is in turn communicated through metering orifices within the control spool valves to respective first output workports 445 of the respective control spool valves. The first output workports 445 of the respective control spool valves 420 are coupled to respective second input workports 455 of the respective control spool valves by way of the respective compensating spool valves 425. Whether hydraulic fluid is communicated between the first output workports 445 and the second input workports 455 depends upon the positioning of the compensating spool valves 425 and the additional valve elements 430, which operate as follows.

As discussed with respect to the first valve assembly 110 of FIG. 2, in order to avoid excessive hydraulic fluid flow to one or another of the actuatable devices 330, 340 and 350, it is desirable to maintain the same pressure differential across each of the control spool valves 420 of the valve sections 335, 345, 355 between the respective first input workports 440 and first output workports 445 of those valves. In the valve assembly 310 of FIG. 3, this is accomplished by way of the interaction of the respective pairs of compensating spool valves 425 and additional valve elements 430 of the respective valve sections 335,345 and 355. The respective compensating spool valve 425 and additional valve element 430 of each respective valve section are pushed apart from one another by a respective spring 460 and also by a respective load pressure 465. Additionally, each respective compensating spool valve 425 is pushed toward its respective additional valve element 430 by the hydraulic fluid pressure existing at the respective first output workport 445 of the respective control spool valve 420, and each respective additional valve element 430 is pushed toward the respective compensating spool valve 425 by the pressure existing at the load sense port 390 of the pump 320.

Given this configuration of the compensating spool valves 425 and additional valve elements 430, equal pressure drops are maintained across each of the control spool valves 420 of the first, second and third valve sections 335, 345 and 355 as follows. Because each of the additional valve elements 430 is opened to communicate pressure to the load sense passage 395 whenever the respective load pressure 465 applied to it is greater than the pressure in the load sense passage 395, and because the pump pressure provided by the pump 320 varies in response to changes in the pressure of the load sense passage 395, the pressure of the load sense passage 395 tends to equal the highest of the load pressures 465 (including the load pressures associated with the fourth and fifth actuatable devices 360 and 370 as discussed below). Further, because the respective compensating spool valves 425 are acted upon by both the respective springs 460 and the respective hydraulic load pressures 465, the pressures maintained at the respective first output workports 445 of the respective control spool valves 420 tends to equal the highest of the load pressures as well. Thus, the pressure differential between the first input workport 440 and the first output workport 445 of each of the respective control spool valves 420 of the valve sections 335, 345 and 355 is the same.

Still referring to FIG. 3, the valve assembly 310 also allows adjustable flow control with respect to the hydraulic fluid provided to the fourth and fifth actuatable devices 360 and 370 of the fourth and fifth valve sections 365 and 375, respectively. As in the first, second and third valve sections 335,345 and 355, each of the fourth and fifth valve sections 365 and 375 employs a respective compensating spool valve 425 and a respective control spool valve 420 with respective first and second input workports 440 and 455 and a respective first output workport 445. To provide for adjustable flow control, the valve sections 365 and 375 employ different components in place of the additional valve elements 430. Specifically, respective check valves 470 are coupled in between the load sense passage 395 and each of the respective second input workports 455 of the respective control spool valves 420 so that the load pressure(s) associated with the fourth and fifth actuatable devices 360, 370 are applied to the load sense passage 395 if those pressure(s) are the highest load pressures being experienced by any of the actuatable devices 330, 340, 350, 360 and 370.

Additionally, an adjustable pressure reducing valve 475 is coupled between the supply passage 381 and actuation ports 480 of the respective compensating spool valves 425 of the fourth and fifth valve sections 365 and 375. The actuation ports 480 are opposite other actuation ports of the compensating spool valves 425 that are coupled to the first output workports 445. The adjustable pressure reducing valve 475 operates in response to pressures applied to first and second actuation ports 490 and 495, which are respectively coupled to the load sense passage 395 and to the actuation ports 480 of both of the compensating spool valves 425. Additionally, pressure is applied to the first actuation port 490 by a spring 485, which is adjustable. Due to the presence of the adjustable pressure reducing valve 475, the pressure applied to the actuation ports 480 and consequently applied to the respective first output workports 445 of the respective control spool valves 420 of the fourth and fifth valve sections 365 and 375 is equal to the highest load pressure plus the spring pressure. Thus, assuming the same settings for each of the control spool valves 420 of each of the valve sections 335,345,355,365 and 375, the hydraulic fluid flow provided to each of the fourth and fifth actuatable devices 360 and 370 is the same, and is less than that provided to the first, second and third actuatable devices 330, 340 and 350. In alternate embodiments, the adjustable pressure reducing valve 475 could be coupled to another valve similar to the drive mode selector valve 260 to allow for multiple modes of operation.

Figure 4:
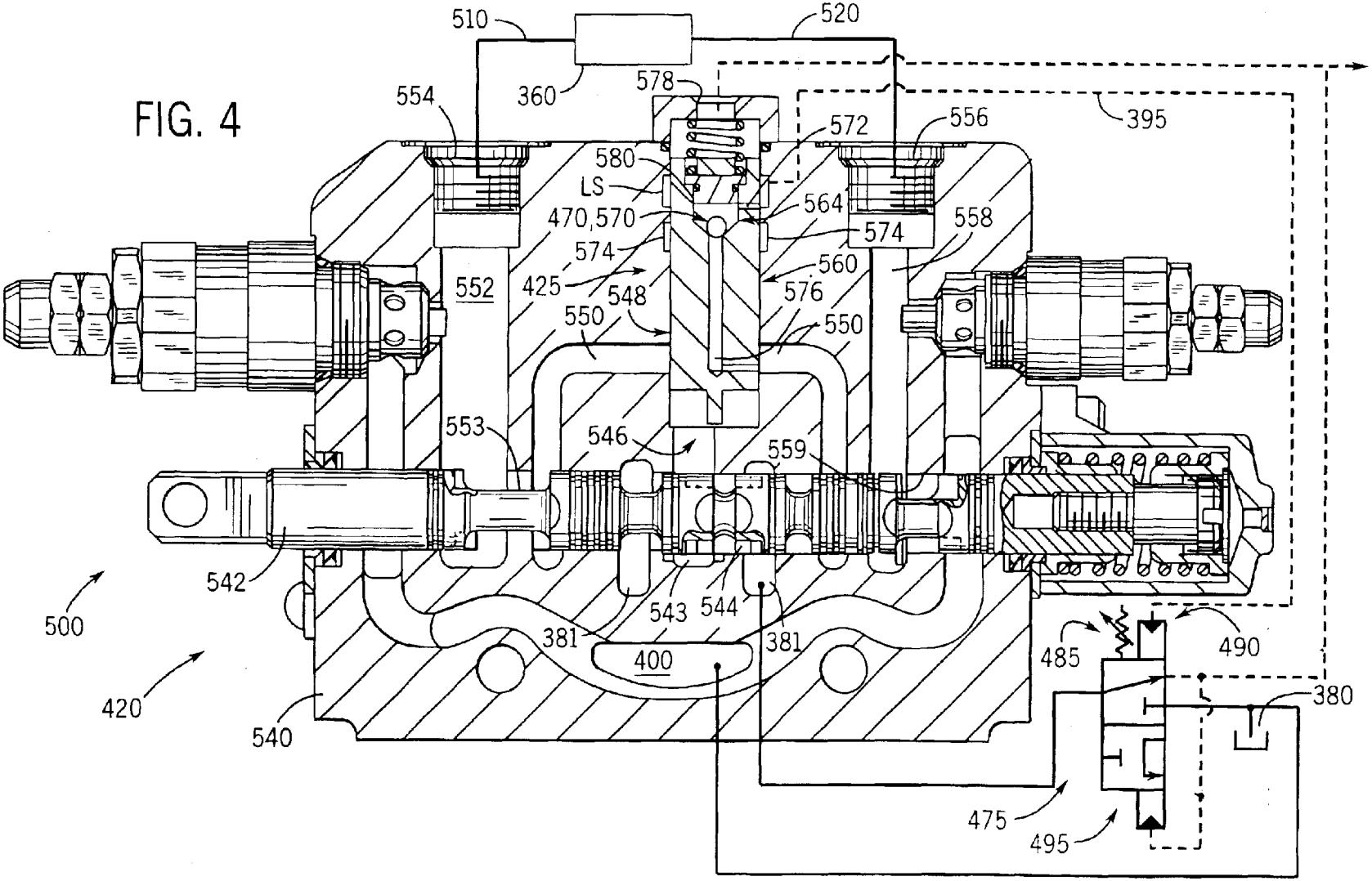
FIG. 4 is a mixed cross-sectional and schematic diagram showing an exemplary valve component and additional components that in certain embodiments can be employed within the hydraulic system of FIG. 3.

Turning to FIG. 4, a cross-sectional view is provided of a valve component 500 that could be employed in each of the fourth and fifth valve sections 365 and 375 of FIG. 3. The valve component 500 particularly shows the control spool valve 420, compensating spool valve 425, and check valve 470 associated with the fourth valve section 365, and further shows in schematic form how the valve component 500 is coupled to the adjustable pressure reducing valve 475 and to the fourth actuatable device 360. As shown, the valve component 500 has a body 540 and control spool 542 that a machine operator can move in reciprocal directions within a bore in the body by operating a control member (not shown) attached thereto. Depending on which direction the control spool 542 is moved, hydraulic fluid is directed toward the actuatable device 360 by way of either a first conduit 510 or a second conduit 520.

To direct hydraulic fluid toward the actuatable device 360 by way of the first conduit 510, the machine operator moves the control spool 542 rightward into the position illustrated in FIG. 4. This opens passages which allow the pump 320 to force hydraulic fluid through the supply passage 381 in the body 540. From the supply passage 381, the hydraulic fluid passes through a metering orifice formed by a set of notches 544 of the control spool 542, through a feeder passage 543 and a variable orifice 546 (see also FIG. 3) formed by the relative position of a compensating spool 548 and an opening in the body 540 to a bridge passage 550.

In the open state of the compensating spool valve 425, the hydraulic fluid travels through the bridge passage 550, a channel 553 of the control spool 542, through a workport passage 552, out of a workport 554 and out through the first conduit 510. Hydraulic fluid returning from the actuatable device 360 by way of the second conduit 520 flows into another valve assembly workport 556, through a workport passage 558, into the control spool 542 via a passage 559 and then into the reservoir passage 400 that is coupled to the tank 380. To direct fluid toward the actuatable device 360 by way of the second conduit 520, the machine operator moves the control spool 542 to the left, which opens a somewhat different set of passages.

FIG. 4 further reveals the check valve 470 and how the check valve interfaces the compensating spool valve 425, which is formed by the compensating spool 548 and the surface of a bore 560 surrounding the compensating spool. Specifically, the check valve 470 is a conventional ball-on-seat check valve, where a ball 570 rests within a bore 564 of the compensating spool 548. Above the ball 570 is a passage 572 protruding out beyond the bore 564 to the perimeter of the compensating spool 548, along which are grooves 574 that are coupled to the load sense passage 395 (not shown). Below the ball is a channel 576 that leads to the bridge passage 550, which leads back to the control spool valve 420 (specifically to the second input port 455 as shown in FIG. 3) and carries the load pressure associated with the actuatable device 360. In alternate embodiments, the check valve can be machined so that it can be positioned externally with respect to the compensating spool valve 425.

Additionally, FIG. 4 shows schematically that the adjustable pressure reducing valve 475 is capable of directing pump pressure from the supply passage 381 to a cavity 578 above the compensating spool 548. Specifically, the valve 475 opens when the sum of the pressures applied by the spring 485 and the load sense passage 395 to the first actuation port 490 is greater than the pressure in the cavity 578, which is applied to the second actuation port 495. As shown, the cavity 578 is separated from the passage 572 by a plug 580 fit into the top of the bore 564 along the top of the compensating spool 548. Thus, the operation of the check valve 470 is distinct from the pressures applied to the compensating spool 548 by way of the cavity 578 and the feeder passage 543.

While the foregoing specification illustrates and describes the preferred embodiments of this invention, it is to be understood that the invention is not limited to the precise construction herein disclosed. The invention can be embodied in other specific forms without departing from the spirit or essential attributes. For example, while spool valves are shown, the invention could also be implemented using various other types of valves. Also, for example, the pressure information provided to the actuation ports of valves could be provided by way of electrical signals that communicated pressure information sensed by transducers, and the various valves actuated by such signals could be electrically-actuated valves. Additionally, for example, the new pressure compensation techniques and systems disclosed herein are applicable to other hydraulically-actuated vehicles besides work vehicles, and are applicable to other hydraulic systems than those implemented in vehicles. Accordingly, reference should be made to the following claims, rather than to the foregoing specification, as indicating the scope of the invention.

What is claimed is:

1. An apparatus for providing a reduced hydraulic flow output to a plurality of actuatable devices, wherein each of the actuatable devices receives respective amounts of hydraulic fluid from a shared pump, and wherein the respective amounts of hydraulic fluid received by the respective actuatable devices are substantially independent of differences in respective load pressures associated with the respective actuatable devices, the apparatus comprising:

a plurality of main valves each having a respective first port and a respective second port;

a plurality of secondary valves coupled respectively to the respective second ports of the respective main valves; and an adjustment valve that has first and second actuation ports and is coupled between respective actuation ports on each of the secondary valves and a pressure source, wherein the first actuation port receives a first indication of a pressure at the respective actuation ports of the secondary valves and the second actuation port receives a second indication of a highest load pressure adjusted by an amount, and wherein the adjustment valve allows hydraulic pressure to be provided from the pressure source to the respective actuation ports of the secondary valves when the second indication exceeds the first indication.

2. The apparatus of claim 1, wherein the respective secondary valves cause respective pressures at the respective second ports to be at respective levels so that respective pressure differentials existing between the respective pairs of the first and second ports of the respective main valves are substantially the same.

3. The apparatus of claim 1, wherein the amount is determined by a spring.

4. The apparatus of claim 1, wherein the spring is adjustable by an operator.

5. The apparatus of claim 1, wherein the pressure source is a pump pressure within a pressure line determined by the pump.

6. The apparatus of claim 1, wherein each of the main valves is a respective spool valve.

7. The apparatus of claim 1, wherein each of the secondary valves is a respective compensation valve, wherein each of the secondary valves in addition to having its respective actuation port includes a respective further actuation port, and wherein the respective further actuation ports of the respective secondary valves are respectively coupled to the respective second ports of the respective main valves.

8. The apparatus of claim 1, wherein each of the secondary valves is a respective spool valve.

9. The apparatus of claim 1, further including a mode selector valve that is actuatable by an operator, wherein the respective actuation ports on each of the secondary valves are coupled to the adjustment valve only when the mode selector valve is in a first position, and wherein the respective actuation ports on each of the secondary valves are coupled to the highest load pressure when the mode selector valve is in a second position.

10. The apparatus of claim 1, further comprising a second plurality of main valves each having a respective first port and a respective second port, and a second plurality of secondary valves, wherein each of the second plurality of secondary valves has respective primary and secondary actuation ports, wherein the respective primary actuation ports are coupled to the respective second ports of the respective main valves of the second plurality of main valves, and wherein the respective secondary actuation ports are coupled to the highest load pressure.

11. The apparatus of claim 10, wherein each of the secondary valves of the second plurality includes a compensation valve that is a spool valve in combination with an additional valve element.

12. The apparatus of claim 11, wherein a first pressure differential exists between the first and second ports of the main valves of the first plurality of main valves, and a second pressure differential exists between the first and second ports of the main valves of the second plurality of main valves.

13. The apparatus of claim 12, wherein a first of the first plurality of main valves is coupled to a first actuatable device and a first of the second plurality of main valves is coupled to a second actuatable device and wherein, when the first and second actuatable devices provide identical load pressures, a first amount of hydraulic fluid flow is provided to the first actuatable device and a second amount of hydraulic fluid flow is provided to the second actuatable device, where the first amount is less than the second amount.

14. The apparatus of claim 1, further comprising a valve assembly including a first of the main valves and a first of the secondary valves, wherein the first main valve is a control spool capable of moving longitudinally through a first cavity within the valve assembly, wherein the first secondary valve is a compensating spool capable of moving longitudinally though a second cavity within the valve assembly, wherein the first secondary valve is moved in a first direction when a first pressure at the second port of the first main valve exceeds a second pressure communicated by the adjustment valve.

15. The apparatus of claim 14, wherein the first secondary valve includes a check valve, wherein the check valve is at least one of:

included within an internal cavity of the first secondary valve that connects first and second orifices along an outer surface of the first secondary valve, and positioned external to the first secondary valve, and wherein the check valve allows hydraulic fluid to flow when a load pressure of a load coupled to the valve assembly is the highest load pressure.

16. A hydraulic system for implementation in a work vehicle, the hydraulic system comprising:

a plurality of actuatable devices;

a plurality of valves having respective metering orifices, wherein the respective valves are coupled to the respective actuatable devices, and wherein hydraulic fluid flow to the respective actuatable devices is determined at least in part by respective areas of the respective metering orifices and respective pressure differentials across the respective metering orifices;

means for regulating the respective pressure differentials across the respective metering orifices so that the respective pressure differentials do not vary substantially in response to variations in the loads at actuatable devices;

means for biasing the means for regulating, so that the respective pressure differentials across the respective metering orifices of more than one of the respective valves are decreased; and means for activating and deactivating the means for biasing.

17. A method of providing different hydraulic fluid flow rates to different actuatable devices, the method comprising:

providing a plurality of control valves, wherein each valve has a respective metering orifice having a respective controllable area;

providing a plurality of secondary valves coupled between the respective metering orifices and the respective actuatable devices;

applying a first pressure related to a highest load pressure to a first group of the secondary valves so that those secondary valves cause a first pressure differential to exist across the metering orifices of each of the control valves coupled to those secondary valves;

applying a second pressure related to a sum of the highest load pressure and a spring pressure to a second group of the secondary valves so that those secondary valves cause a second pressure differential to exist across the metering orifices of each of the control valves coupled to those secondary valves;

receiving operator actuations to adjust the controllable areas of the metering orifices of the respective control valves; and receiving an operator actuation causing an adjustment of the spring pressure, which in turn causes an adjustment of the second pressure.

18. The method of claim 17, further comprising:

receiving an operator actuation causing an additional valve to change state so that the second pressure is applied to the second group of the compensation valves rather than the first pressure.

* * * * *